US008572784B2

(12) United States Patent
Keehfus

(10) Patent No.: US 8,572,784 B2
(45) Date of Patent: Nov. 5, 2013

(54) BED ORGANIZER

(76) Inventor: Todd Edward Keehfus, Skaneateles, NY (US)

( * ) Notice: Subject to any disclaimer, the term of this patent is extended or adjusted under 35 U.S.C. 154(b) by 0 days.

(21) Appl. No.: 13/456,903

(22) Filed: Apr. 26, 2012

(65) Prior Publication Data

US 2012/0211622 A1 Aug. 23, 2012

Related U.S. Application Data

(63) Continuation of application No. 12/778,412, filed on May 12, 2010, now Pat. No. 8,185,987.

(51) Int. Cl.
*A47C 31/00* (2006.01)
*A47C 21/00* (2006.01)

(52) U.S. Cl.
USPC ..... 5/658; 5/503.1; 248/311.2; 297/188.2

(58) Field of Classification Search
USPC ..... 5/95, 308, 658, 503.1, 513, 417, 420, 5/905; 248/690, 230.8, 311.2; 297/188, 297/188.2
See application file for complete search history.

(56) References Cited

U.S. PATENT DOCUMENTS

| | | | | |
|---|---|---|---|---|
| 2,086,244 | A * | 7/1937 | Smith | 297/411.24 |
| 3,708,808 | A * | 1/1973 | Irby | 5/95 |
| 3,873,010 | A * | 3/1975 | Patterson | 224/275 |
| 5,022,107 | A * | 6/1991 | Knotts | 5/419 |
| 5,527,091 | A * | 6/1996 | Gruber | 297/188.01 |
| 5,911,472 | A * | 6/1999 | Toth | 297/188.2 |
| 6,015,198 | A * | 1/2000 | Stair | 312/235.1 |
| 7,284,791 | B1 * | 10/2007 | Wright | 297/188.18 |
| 7,334,838 | B2 * | 2/2008 | Pope | 297/188.14 |
| 8,185,987 | B2 * | 5/2012 | Keehfus | 5/658 |

* cited by examiner

*Primary Examiner* — Michael Trettel
(74) *Attorney, Agent, or Firm* — Kegler Brown Hill & Ritter; James J. Pingor

(57) ABSTRACT

An apparatus that facilitates storage of items for convenient access while in bed is provided. The apparatus offers a new and improved way to address the special needs of this type storage by utilizing a foam body portion having a variety of specially designed cavities therein. The body is held in place using a fastener and paddle arrangement. The caddy can rest atop a mattress, and therefore does not interfere with a person getting into or leaving the bed.

20 Claims, 11 Drawing Sheets

BED ORGANIZER

CROSS-REFERENCE TO RELATED APPLICATIONS

This application is a Continuation of pending U.S. patent application Ser. No. 12/778,412 entitled "BED ORGANIZER" filed on May 12, 2010, now U.S. Pat. No. 8,185,987, the entirety of which is incorporated herein by reference.

BACKGROUND

There are many items that people may store for convenient access while in bed or when entering or leaving the bed. Such items include television remote control devices, flashlights, wireless and cellular telephones, medication, bottled or canned beverages, and facial tissue or personal items such as watches, jewelry, wallets, etc.

Nearby shelves or night stands placed at the side of a bed can provide storage for such items, but they can soon become cluttered and visually unpleasant. Conventionally, bedside organizers typically relate to suspended containers or caddies that are placed upon a night stand or alternatively, hang along the sides of the bed. Most conventional caddies are made of flexible material and feature a series of pockets intended to generally hold various objects.

Today, as people store more and more items in or on a bed, it is difficult to keep track of them or they are often lost by falling off the edge of the mattress. For example, oftentimes a person will have more than one television remote control, e.g., one might control the television, one might control a DVD (digital versatile disk) player and one might even control an overhead ceiling fan. Throughout the night, these items can become inadvertently moved around or even lost, which oftentimes makes it difficult to locate them.

This is especially important for the elderly who often have a difficult time searching for or otherwise locating these items. It is not uncommon that items fall under or behind the bed. As a result, those with limited agility have an arduous time locating and retrieving these items. For this reason, many times, items are placed on a night stand next to the bed. Unfortunately, as surface areas of night stands get crowded, this storage location is not always convenient, especially for those that are not as mobile, e.g., the elderly or ill.

SUMMARY

The following presents a simplified summary of the innovation in order to provide a basic understanding of some aspects of the innovation. This summary is not an extensive overview of the innovation. It is not intended to identify key/critical elements of the innovation or to delineate the scope of the innovation. Its sole purpose is to present some concepts of the innovation in a simplified form as a prelude to the more detailed description that is presented later.

Storage of items for convenient access while in bed or when entering or leaving bed is oftentimes not adequately accomplished via nightstands or nearby shelves alone. In recognition of this, suspended caddies have been used. Unfortunately, they too have many inadequacies.

This subject innovative bed caddy offers a new and improved way to address the special needs of this type of storage. Because existing suspended caddies are constructed of flexible materials and provide storage space in shapeless pockets, frequently with flaps covering the pocket openings, it is difficult if not impossible to organize stored items in a neat and easily accessible manner. Additionally, larger items such as facial tissue boxes and beverage containers cannot be placed in the pockets at all.

The subject innovation, in aspects thereof, includes an organizer or bed caddy that is formed of more rigid materials and provides distinctively shaped open storage cavities so that items with specific shapes can be easily organized and readily accessed. The caddy includes cavities specially configured to accept such larger items.

Furthermore, the innovation can rest atop a mattress, and therefore does not interfere with a person getting into or leaving the bed. Suspended caddies on the other hand often occupy space within the path of entry and egress. Many of the suspended type storage devices are difficult to install and remove. Some require that the mattress be completely removed for caddy installation and removal. In accordance with aspects of the innovation, each of two flat paddles need only to be slipped in beneath the mattress and the bed caddy is installed.

In other aspects, a cover sleeve is provided that encases the caddy body. Being able to remove the cover for cleaning is another advantage of the innovation and so too is its adjustability. Because the length of its cushion-like body can be designed to fit within the width of the smallest standard mattress, and because the length of its securing straps can be easily adjusted to be longer (or shorter), the bed caddy will fit most any of the larger standard mattresses as well.

To the accomplishment of the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1:
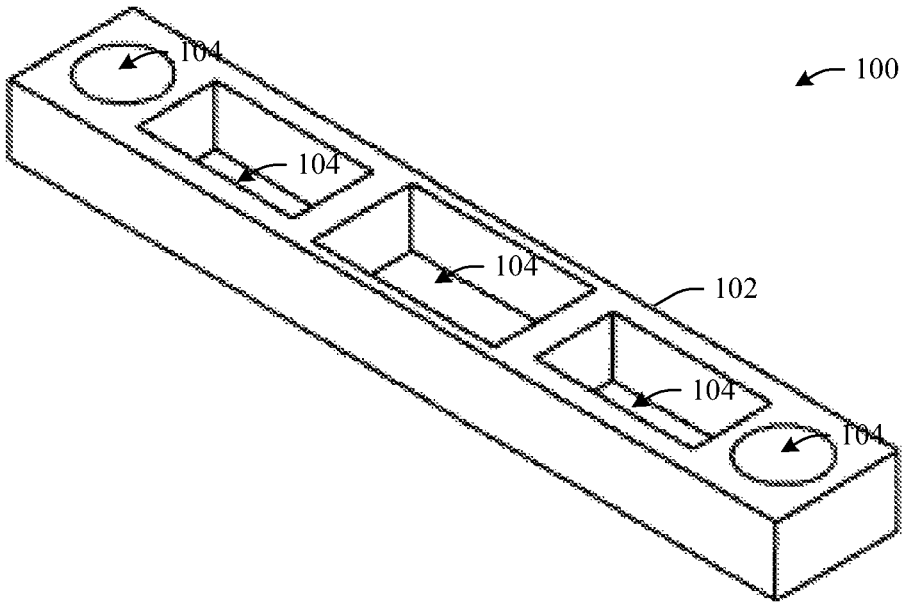
FIG. 1 illustrates a top side perspective view of a bed caddy body in accordance with aspects of the innovation.

The innovation is now described with reference to the drawings, wherein like reference numerals and naming conventions are used to refer to like elements throughout. In the following description, for purposes of explanation, numerous specific details are set forth in order to provide a thorough understanding of the subject innovation. It may be evident, however, that the innovation can be practiced without these specific details.

Although bedside organizers can provide space for the storage of many items, it is recognized that conventional organizers have disadvantages. It is therefore one goal of the subject innovation to disclose an improved organizer (e.g., bed caddy) that alleviates disadvantages of traditional devices and methods of storing items, for example, on the side or next to a bed.

As will be disclosed in detail below, aspects of the innovation disclose a bed caddy that can keep the items stored within it readily accessible so that they may be easily retrieved by the user, e.g., while in bed. In other aspects, the specification discloses a bed caddy that includes a plurality of defined storage spaces, each appropriately sized and shaped to accommodate specific items. Accordingly, the innovation can comprise a compartmentalized container that, unlike conventional approaches, will rest atop a mattress, extending between the sides of the mattress, its length defined so as to fit within the width of most any one of a variety of standard size mattresses.

Additionally, it will be understood upon a review of the specification that follows that the innovation can be easily attachable to a bed, and can be removable with equal ease when the bed is to be made, when bed coverings are to be changed or when the bed caddy is to be cleaned. While aspects are disclosed that employ a cloth sleeve, it is to be understood that the bed caddy body itself can be manufactured of cleanable materials or foams. Each of these aspects will be better understood upon a review of the figures that follow.

Referring initially to FIG. 1, a perspective view of an organizer or caddy 100 in accordance with aspects of the innovation is shown. The caddy 100 can include a body 102 configured with various cavities 104 disposed therein. Each of the cavities 104 can be specifically sized to accommodate a particular item or group of items. For example, circular cavities can be provided to secure a beverage container, e.g., a water bottle or soda can. Other cavities can be provided to house facial tissue boxes, electronic remote control devices, keys, telephones, books or the like. It is to be understood that the examples of items and configurations of cavities are endless. Thus, alternative configurations of organizer 100 are to be included within the scope of this disclosure and claims appended hereto.

The body 102 can be constructed of most any flexible, compressible or rigid material. In a particular aspect, the body 102 is constructed of foam which compresses upon load and reverts to its original form when the load is removed. For example, a flame-retardant injection foam can be employed to construct the body 102. As will be understood upon a review of the figures that follow, the body 102 can be covered with a sleeve (not shown), for example, a custom-tailored cloth sleeve. The cloth sleeve can be washable and designed to match a desired decor or theme.

Figure 2A:
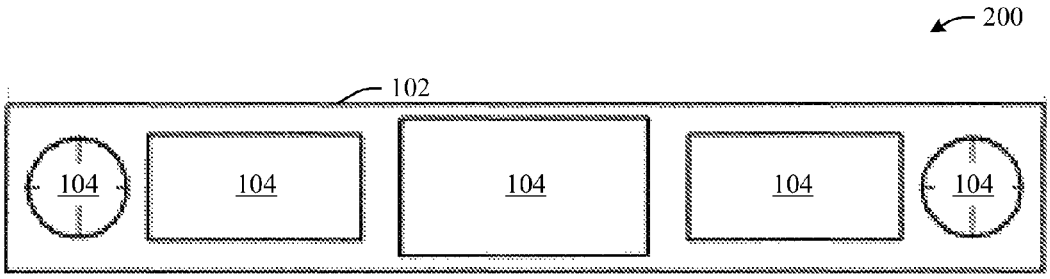
FIG. 2A illustrates a top plan view of a bed caddy body in accordance with aspects of the innovation.
Figure 2B:
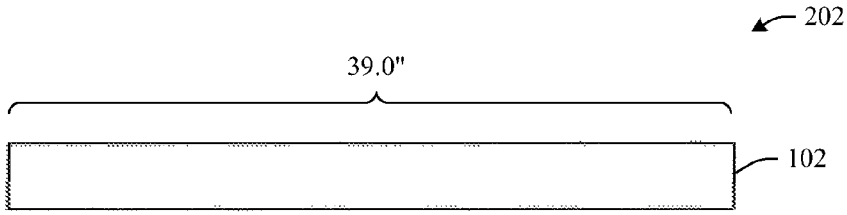
FIG. 2B illustrates a front elevation view of a bed caddy body in accordance with aspects of the innovation.
Figure 2C:
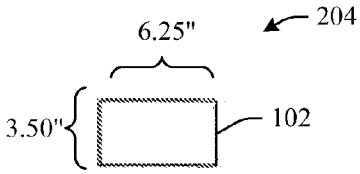
FIG. 2C illustrates a side elevation view of a bed caddy body in accordance with aspects of the innovation.

FIGS. 2A, 2B and 2C illustrate top plan (200), front elevation (202) and side elevation (204) views respectively of the aspect of FIG. 1. It is to be understood that while specific dimensions and/or configurations are shown, countless alternatives exist, each of which is to be considered within the scope of this specification. For example, while the example of FIG. 1 is rectangular in shape, other aspects can be square, circular, oval or the like while retaining core features, functions and benefits described herein.

As shown in FIGS. 2A, 2B and 2C, a variety of viewpoints convey the scale and size of a particular aspect. These figures illustrate three orthographic views of the cushion-like body 102 with overall outside dimensions shown. It will be understood that the physical size of the innovation can be designed by preference or otherwise to fit a particular piece of furniture (e.g., King, Queen, Full or Twin size bed). As described above, body 102 can be covered with a cloth sleeve or case (not shown). In most aspects, the sleeve can be fabricated to encase the body 102. In other aspects, elastic, Velcro™, snaps or the like can be employed to fit the sleeve atop the body 102.

Figure 3:
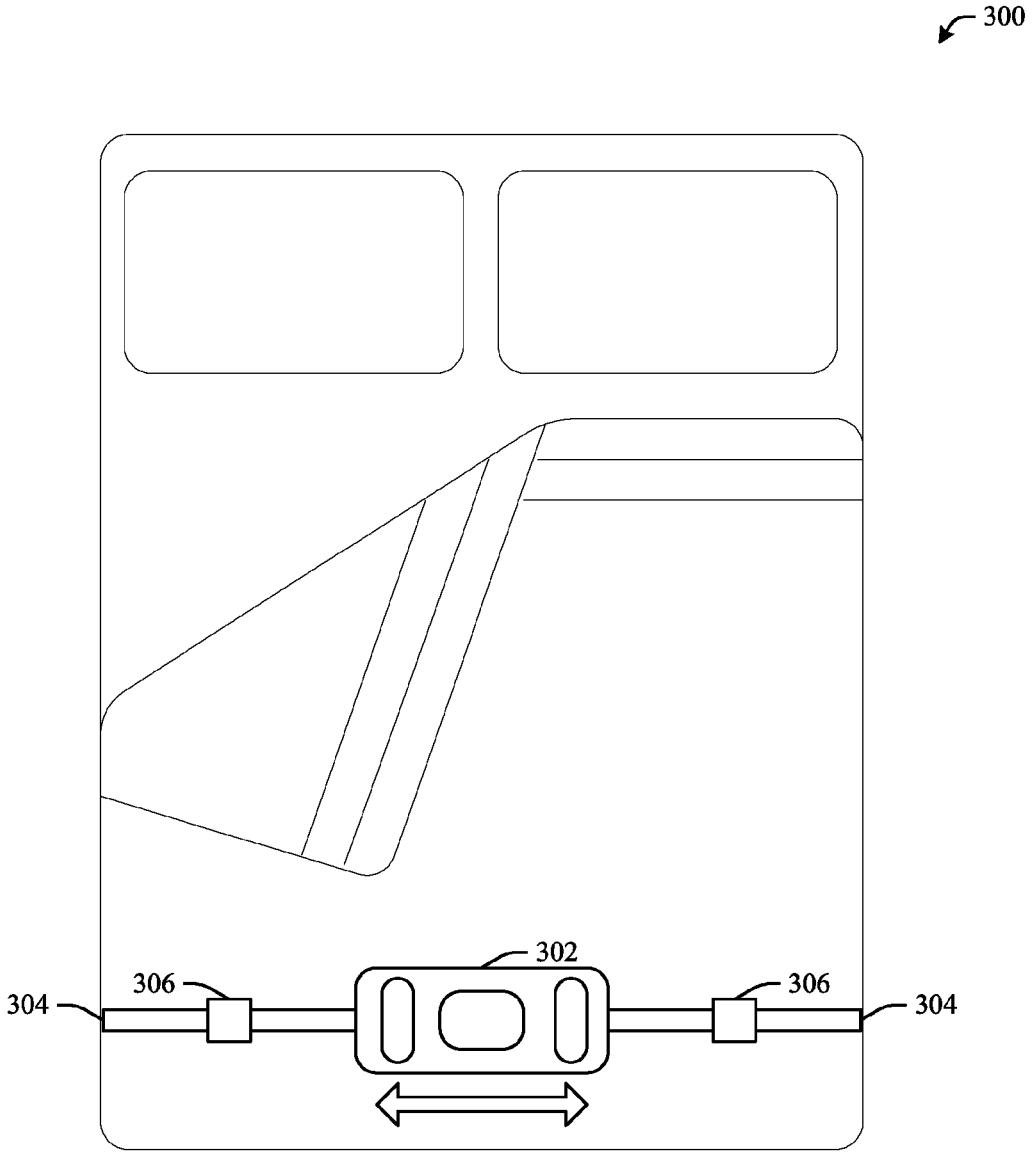
FIG. 3 illustrates a caddy orientation in accordance with aspects of the innovation.

Referring now to FIG. 3, an aspect 300 of the innovation is shown. As illustrated, the subject innovation discloses a bed caddy that can rest atop (and be secured to) a mattress. The caddy can be manufactured of a cushion-like body 302 having a top, a bottom, a front, a rear, and two opposing ends. In this example, the body is substantially rectangular in shape. Other aspects are contemplated where the body is configured in other shapes including, but not limited to, square, round, oval, or the like.

With continued reference to the example of FIG. 3, the cushion-like body 302 has a specific length to fit within the width of most any one of a variety of mattress sizes, e.g., King, Queen, Full, or Twin size mattresses. For instance, in one embodiment, the body 302 has a 39.00 inch length so as to fit within the width of a twin (or single) size or larger mattress as defined by United States standards. The cushion-like body can be formed of a cushioning material such as, for example, grade 16000 polyurethane foam having a density rating of 1.45 to 1.50 pounds per cubic foot (PCF) and 35% minimum resilience.

The cushion-like body can flex under load, but will return to its original shape when the load is removed. While a cushion-type body is disclosed and described in detail, it is to be understood that other aspects can employ most any structural body (e.g., injected plastic) without departing from the spirit and/or scope of this innovation.

As illustrated in the figures, the cushion-like body 302 can include a plurality of storage cavities with each cavity open at its top and extending downwardly into the cushion-like body 302. In addition to generally sized cavities, each of the cavities can be configured to have a unique size and shape for storage of specific items. For example, cavities can be sized to accept and house an object such as, for example, a standard sized facial tissue box or a beverage container.

A securing strap or fastener 304 can be attached to the bottom surface of the cushion-like body 302 proximate a one long side of the cushion-like body 302. In other aspects, the fastener(s) 304 can be removably attached to opposing ends of the body 302. In yet other aspects, the fastener(s) can be attached to a sleeve (not shown) that encases the body 302. These and other manners by which to attach fastener(s) 304 are to be included within the scope of this specification and claims appended hereto.

Each of the fasteners 304 can be equipped with an adjustment means 306 as shown. The adjustment means 306 enable the fasteners 304 (straps) to be adjusted so as to snuggly fit atop a desired mattress size. Installation of an example caddy is described in accordance with FIG. 4.

Figure 4:
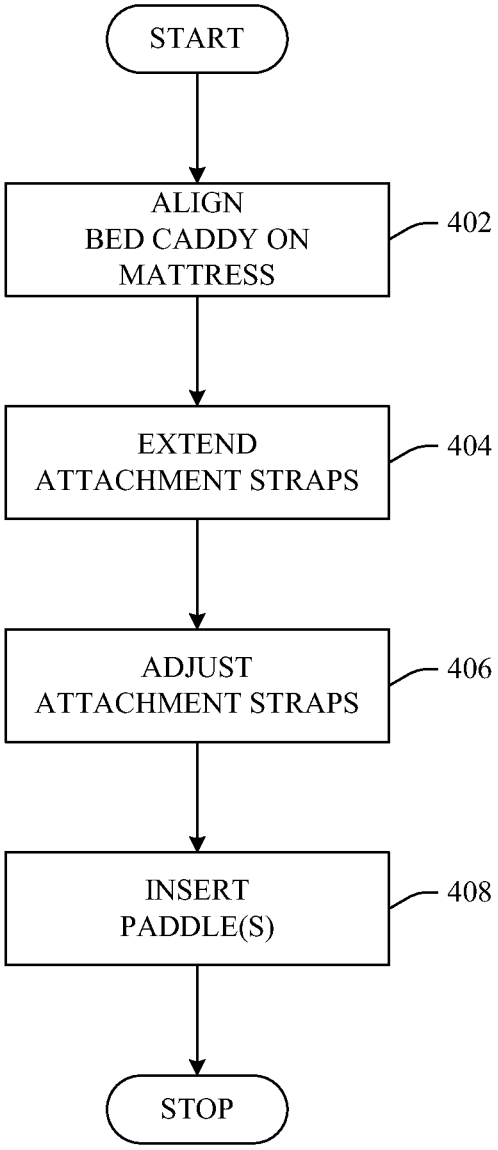
FIG. 4 illustrates an example flow chart of procedures that facilitate installation of a caddy in accordance with an aspect of the innovation.

FIG. 4 illustrates a methodology of installing a bed caddy in accordance with an aspect of the innovation. While, for purposes of simplicity of explanation, the methodology shown herein, e.g., in the form of a flow chart, is shown and described as a series of acts, it is to be understood and appreciated that the subject innovation is not limited by the order of acts, as some acts may, in accordance with the innovation, occur in a different order and/or concurrently with other acts from that shown and described herein. Moreover, not all illustrated acts may be required to implement a methodology in accordance with the innovation.

At 402, a bed caddy can be aligned atop a mattress. For example, the caddy can be placed horizontally across a mattress and parallel to the footboard or headboard as desired. Additionally, if desired, the caddy body can be angularly placed across a corner of the mattress. Each of these example placements are shown in the figures that follow.

At 404, once placed, the straps, or fasteners, can be extended outwardly from opposing sides of the caddy body. The straps can be adjusted at 406 so as to snugly fit a particular mattress size. It will be understood that adjustable straps enable a caddy to be adapted to fit a variety of sized mattresses.

Once adjusted, paddles attached to the end of each of the straps can be inserted under the mattress. For example, the mattress can be slightly lifted such that a user can insert the paddle (together with a portion of the strap) between the mattress and box spring or foundation of a bed. The friction produced by the weight of the mattress can secure the paddles thereby securing the caddy body atop the mattress.

Figure 5:
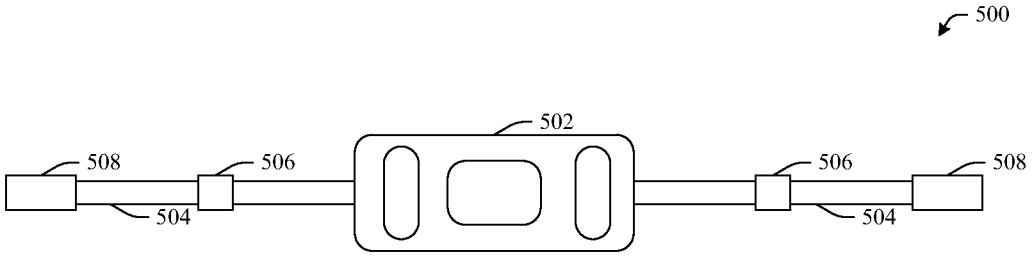
FIG. 5 illustrates a top plan view of an example bed caddy in accordance with an aspect of the innovation.

An alternative aspect of a bed caddy 500 is illustrated in FIG. 5. As shown, the caddy 500 includes a body portion 502, for example, a foam body portion. One contiguous or a pair of straps 504 can be fixedly or removably attached to the body portion 502. Alternatively, the strap(s) 504 can be fixedly or removably attached to a body sleeve (not shown).

As shown, each opposing length of the strap(s) 504 is equipped with an adjustment means 506 that enables one to selectively adjust the length of each opposing end. For example, the length can be adjusted to accommodate a particular mattress size. Additionally, the length(s) can be adjusted to accommodate a particular placement, for example, horizontal or diagonal placement atop a mattress. Each opposing end of the strap(s) 504 can be equipped with a paddle or paddle-like apparatus 508. As described with reference to FIG. 4, the paddle(s) 508 can be positioned between a mattress and box spring or foundation of a bed to frictionally secure the caddy body 502 atop a mattress.

As illustrated in FIG. 5, the adjustment means 506 can be a pair of rigid thin buckles, each buckle having a front side and a rear side wherein each buckle is formed of a rigid material such as an injection molded thermoplastic material, for example, polyethylene (PE) of polypropylene (PP). Each buckle 506 can include two parallel slots penetrating its thickness, each said slot being slightly longer (or larger) than the width of the securing strap or fastener 504 and each said slot being slightly wider than two times the thickness of the securing strap 504.

The securing strap 504 is routed through a buckle 506 passing first from the rear side of the buckle 506 upwardly through a first slot then passing downwardly through a second slot to be routed then downwardly again through a similar slot penetrating a one of the aforementioned flat paddles 508 before being routed back through the buckle 508 reverse the direction of the first passage therethrough. The securing strap 504 can then be folded back upon itself, whereupon the securing strap 504 is fixedly attached to itself using most any suitable technique such as sewing, thus forming a closed loop to capture the buckle 506.

The buckle 506 serves as a means by which the length of the securing strap 504 may be adjusted. It is to be understood that this adjustment enables a fully assembled bed caddy to be securely fitted to a mattress of any size, so long as that size is within the range of the sizes of the defined standards.

As discussed supra, an embodiment includes a cushion-like body 502 having a plurality of cavities therein, a sleeve-type cover (not shown), a securing strap 504, a flat paddle pair set 508, and a pair of buckles 506, all in combination.

In another embodiment of the subject innovation, an alternative material can be used to form the cushion-like body 502. For example, the body 502 can be manufactured of a slow recovery foam such as, for example, viscoelastic polyurethane foam (memory foam) having a density of about 5.3 pounds per cubic foot (PCF) or greater. In this example, the cushion-like body 502 will flex under load although the load will be greater than would be the case if a less dense material were to be used to form the body 502.

As in previous aspects, the cushion-like body 502 will return to its original shape when the load is removed, albeit more slowly than would be the case if a less dense material were to be used to form the body 502.

Figure 6:
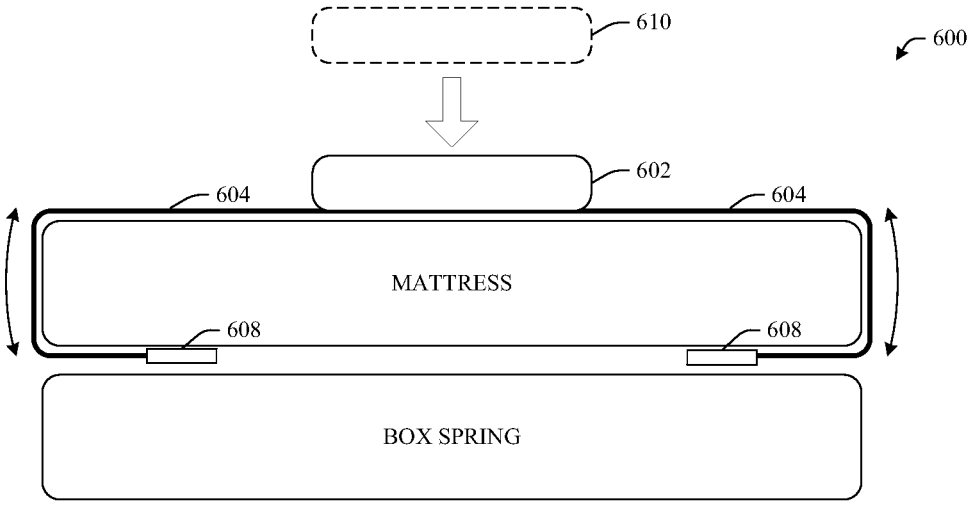
FIG. 6 illustrates an example bed caddy installation in accordance with aspects of the innovation.

Turning now to FIG. 6, an example implementation of a bed caddy 600 in accordance with an aspect of the innovation is shown. As illustrated, a caddy body 602 is positioned atop a mattress, which rests on top of a foundation (e.g., box spring). Fastener straps 604 are connected to each side of the body 602. In this example, the securing strap(s) 604 extend substantially equidistant outwardly beyond the respective left and right ends of the cushion-like body 602. The securing strap(s) 604 can be of such length that its opposing ends may each be separately inserted between a mattress and a mattress support structure (e.g., foundation) when the cushion-like body 602 is resting atop a substantially central portion of the mattress.

The strap(s) can be formed of a flexible material such as for example woven nylon. In other aspects, the straps 604 can be elastic such that they can be stretched to a desired length. Paddles 608 can be fixedly connected to opposing ends of the fastener straps 604 such that, when placed between the mattress and the box spring, the straps 604 are taut thereby securing the body 602.

A sleeve-type cover 610 formed to enclose or encase the cushion-like body 602 can be provided. In most aspects, the sleeve-type cover 610 can be made of a washable fabric such as, for example, cotton or a cotton and polyester blend. The sleeve-type cover 610 can include a pair of flaps that define its bottom panel, one flap adapted to overlap the other flap. The flaps may be separated as needed to allow the sleeve-type cover 610 to be slipped on or off the cushion-like body 602. The flaps may be temporarily joined one atop the other via a plurality of hook and loop fasteners, Velcro™, etc. When closed, the flaps form a single bottom panel to fully enclose the cushion-like body 602.

In yet another embodiment, the bottom surface of the sleeve-type cover 610 is adapted to allow access to the cushion-like body 602 therein via an alternative closure means. For example, the closure means can include a mechanical separable fabric fastener such as a plastic-molded zipper-type connector. An edge of a first sleeve-type cover flap can then be temporarily joined with an edge of a second sleeve-type cover flap. The first sleeve-type cover flap and said second sleeve-type cover flap are held in a closed position over the entire length of the sleeve-type cover using the zipper-type mechanism.

Figure 7:
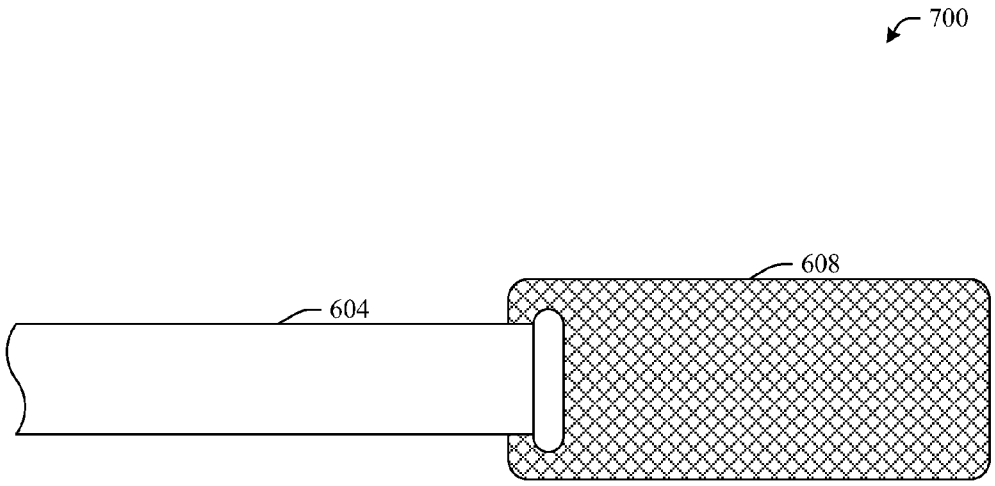
FIG. 7 illustrates a paddle assembly in accordance with aspects of the innovation.

As described above, a pair of flat paddles 608 can be employed, each formed of a rigid thermoplastic material such as, for example, polyethylene (PE), polypropylene (PP), or acrylonitrile butadiene styrene (ABS). In one embodiment, each flat paddle may be approximately 8.00 inches long by 2.50 inches wide by no more than 0.080 inch to 0.090 inch thick. An example paddle assembly 700 is illustrated in FIG. 7. As described supra, a paddle 608 can be fixedly attached to a fastener strap 604, and a paddle 608 can include a textured side or face(s) that enhances adhesion properties when sandwiched between a mattress and box spring as shown in FIG. 6.

Each flat paddle 608 can be adjustably attachable to one opposing end of the securing strap 604 as discussed above. The flat paddle(s) 608 may be produced by most any manufacturing process that will assure consistently flat bun-free parts. As described in detail with regard to FIG. 6, each paddle 608 may be slid between a mattress and a mattress support structure such as, for example, a box spring without causing damage to the contacted surface of either the mattress or the mattress support structure (e.g., box spring). Each flat paddle 608 may be held in place by the friction caused by the weight of the mattress. While paddles are described in this embodiment, it is to be understood that other aspects can employ alternative connecting mechanisms including, but not limited to, hooks, snaps, Velcro™, etc. By way of example, rather than employing paddles between a mattress and support structure, the fastener straps can be wrapped around bed rails and snapped or otherwise connected to oneself thereby securing the caddy atop the mattress.

Figure 8:
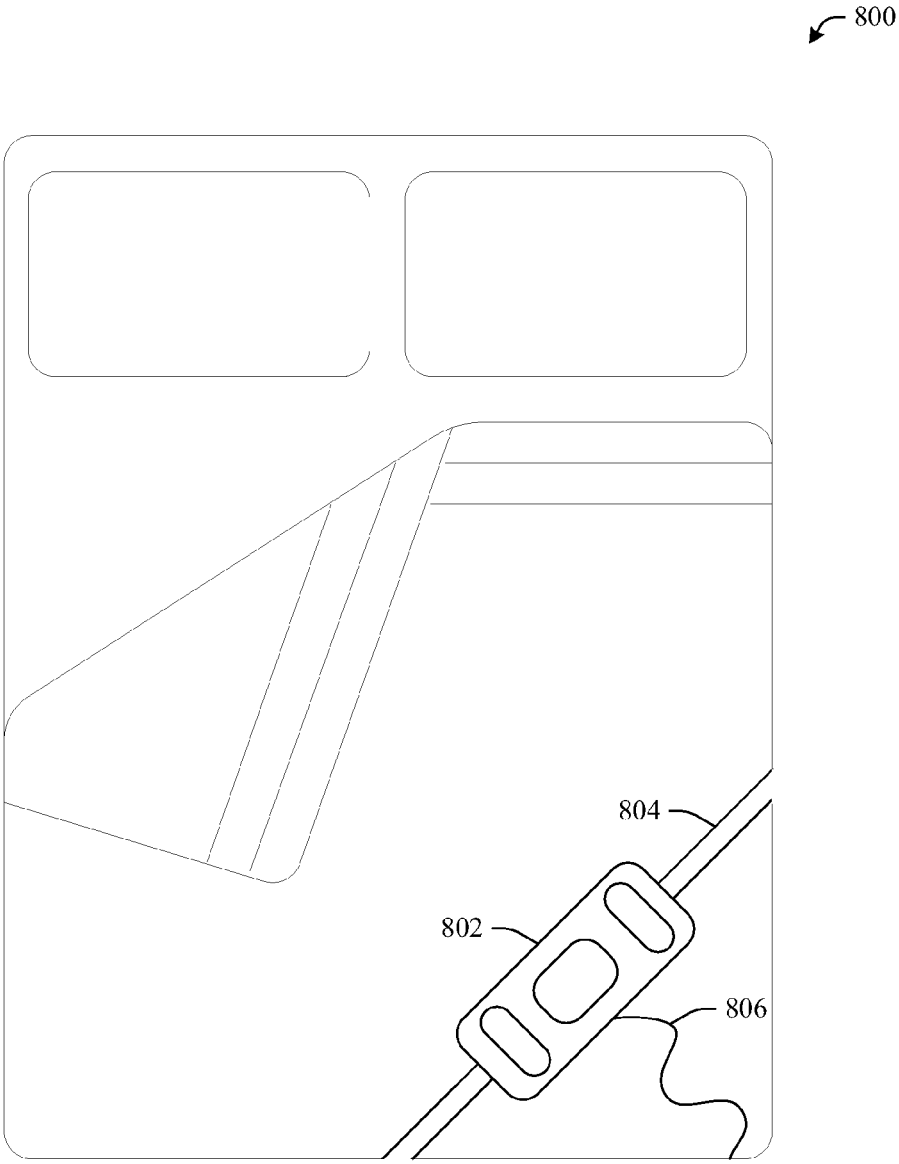
FIG. 8 illustrates an alternative caddy orientation in accordance with aspects of the innovation.
Figure 9:
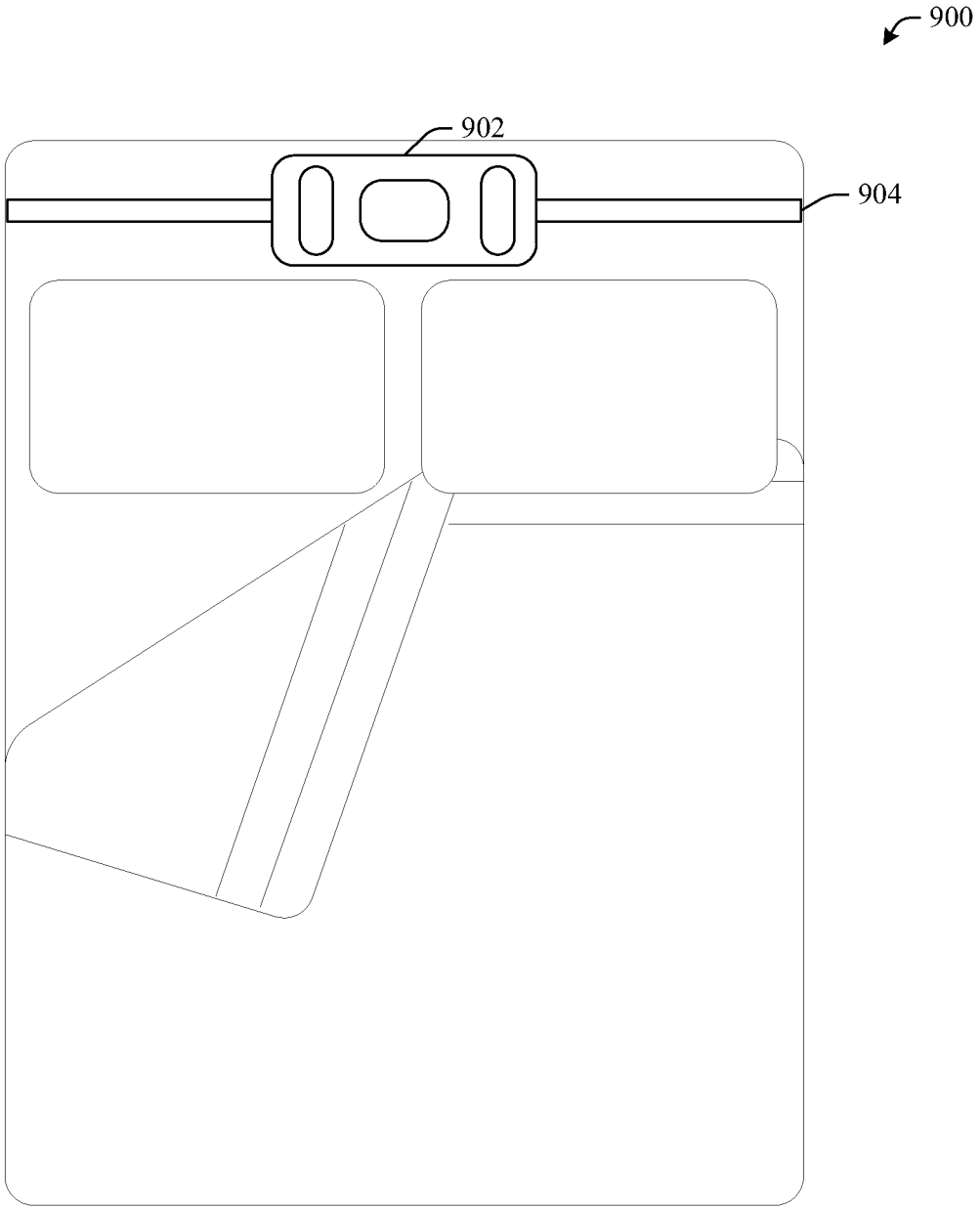
FIG. 9 illustrates an alternative caddy orientation in accordance with aspects of the innovation.

FIGS. 8 and 9 demonstrate alternative placements and orientations of a bed caddy in accordance with aspects of the innovation. Referring to FIG. 8, an angular configuration 800 is shown. As illustrated, a caddy body 802 can be angularly positioned spanning a corner of a mattress. Here, straps 804 can be selectively adjusted, for example, as described supra. Paddles (not shown) or other connection mechanisms can be employed to secure the fastener straps 804 between a mattress and support structure or, alternatively, to a bed frame.

In yet another embodiment, a bed caddy body 802 can be equipped with electrical connection means such that AC (alternating current) or DC (direct current) can be provided. Here, a cord 806 can be employed to provide electricity or power to the caddy body 802. Accordingly, the caddy body 802 can be equipped with beverage warmers, battery chargers (e.g., cell phone chargers), etc. Additionally, the caddy body 802 can include an AC outlet such that items can draw power from the caddy itself. For example, a user can plug a laptop or other electrical device directly into the caddy for use while in bed.

FIG. 9 illustrates an alternative configuration 900 in accordance with aspects. Here, a caddy body 902 can be positioned horizontally across a mattress, parallel to a headboard. Consistent with the aforementioned examples, fastener straps 904 can be employed to secure the caddy body 902 in place.

Figure 10:
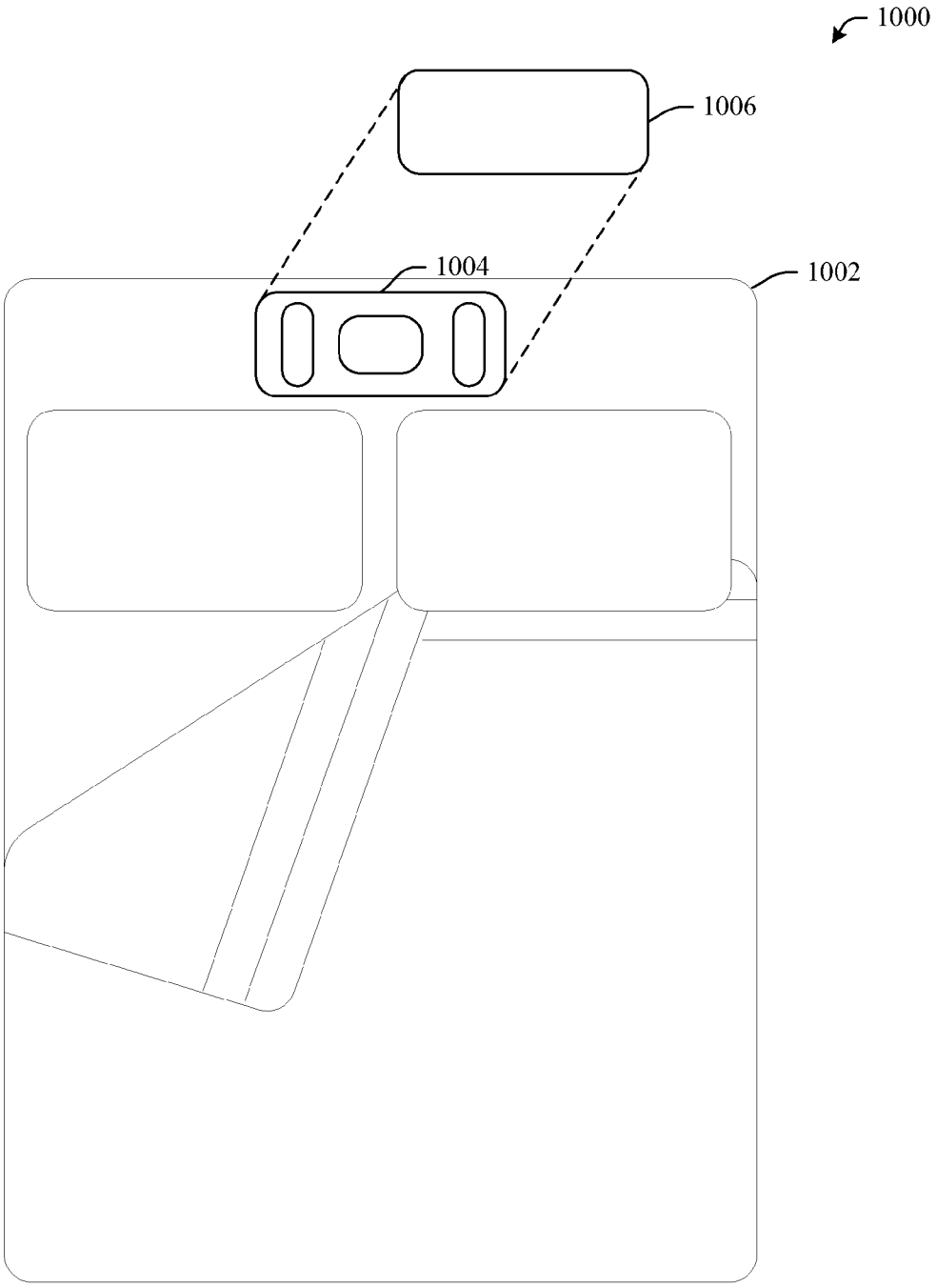
FIG. 10 illustrates a molded-in caddy mattress in accordance with an aspect of the innovation.

FIG. 10 illustrates yet another implementation 1000 of the innovation. Here, a mattress 1002 can be molded to include the caddy body 1004 together with a plurality of cavities. For example, in this implementation, the mattress 1002 can be constructed of a foam material such as memory foam or the like. A cover 1006 can be optionally provided so as to cover the caddy when not in use or as desired. It will be understood that the cover 1006 can be press fit, snap-fit, etc. Similarly, as described above, the caddy 1004 can be electrically equipped so as to provide power to devices as appropriate or desired.

Figure 11A:
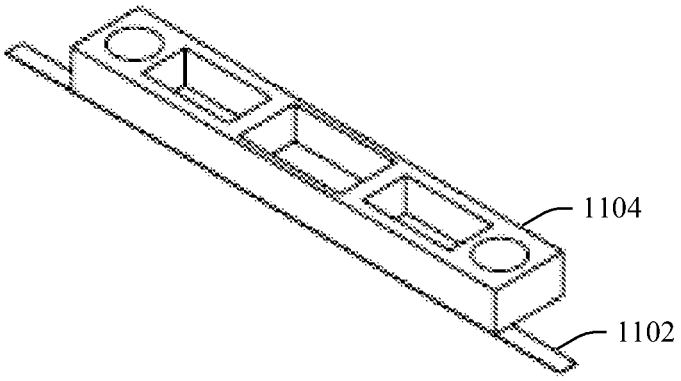
FIGS. 11A and 11B illustrate a strap or fastener placement in relation to a caddy body in accordance with an aspect of the innovation.
Figure 11B:
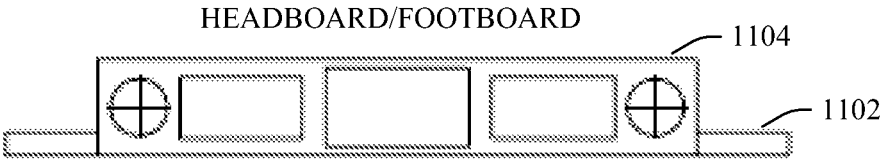

FIGS. 11A and 11B illustrate placement of an attachment fastener or strap to a caddy body in accordance with aspects of the innovation. As will be understood, as illustrated, in this aspect, the strap 1102 is attached with one edge aligned with a one long edge of the body 1104. It is to be understood that, in this installation configuration, the strap-side of the body will rest away from the headboard or footboard of a bed rather than abutting either of those two barriers. This facilitates adequate attachment to the mattress, away from the edge of the mattress.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A storage apparatus, comprising:

a body portion that includes at least one cavity therein, wherein the cavity facilitates storage of a plurality of items;

a cloth sleeve that encases the body portion;

a pair of straps connected to opposing sides of the body portion, the pair of straps having an edge aligned with an edge of the body portion; and electrical connection means, wherein the electrical connection means provides at least one of battery charging means or liquid warming means.

2. The apparatus of claim 1, wherein the body portion is a foam body portion.

3. The apparatus of claim 1, wherein the body portion is a fire-retardant injected foam body portion.

4. The apparatus of claim 1, further comprising a pair of adjustment means that facilitate length adjustment of each of the pair of straps.

5. The apparatus of claim 1, wherein each of the pair of straps is an elastic strap.

6. The apparatus of claim 1, further comprising a pair of friction paddles, each of the friction paddles fixedly attached to an end of each strap opposite of the body portion, wherein the pair of friction paddles secures the body portion via weight of a mattress.

7. The apparatus of claim 1, further comprising strap attachment means on each side of the body portion, wherein each of the pair of straps are removably attachable to each side of the body portion.

8. A furniture apparatus, comprising:

a foam body;

a plurality of organizer cavities molded into a portion of the foam body;

a continuous strap connected to the body portion, such that an edge of the continuous strap is aligned with an edge of the foam body; and a power outlet to supply electrical power to external electronic devices.

9. The furniture apparatus of claim 8, further comprising a cover portion that removably covers the plurality of organizer cavities molded into the portion of the foam body.

10. The furniture apparatus of claim 8, each of the plurality of organizer cavities has a unique shape that facilitates storage of a specific item.

11. The furniture apparatus of claim 8, further comprising power means that provides electricity to a subset of the plurality of organizer cavities.

12. The apparatus of claim 8, wherein the body portion is a fire-retardant injected foam body portion.

13. A storage apparatus, comprising:

a body portion having a foam body portion that includes at least one cavity therein, wherein the at least one cavity facilitates storage of a plurality of items;

a pair of straps connected to opposing sides of the body portion, the pair of straps having an edge aligned with an edge of the body portion; and electrical connection means, wherein the electrical connection means provides at least one of battery charging means or liquid warming means.

14. The apparatus of claim 13, wherein the body portion is a fire-retardant injected foam body portion.

15. The apparatus of claim 13 further comprising a cloth sleeve that encases the body portion.

16. The apparatus of claim 13 further comprising a pair of adjustment means that facilitate length adjustment of each of the pair of straps.

17. The apparatus of claim 13, wherein each of the pair of straps is an elastic strap.

18. The apparatus of claim 13 further comprising a pair of friction paddles, each of the friction paddles fixedly attached to an end of each strap opposite of the body portion, wherein the pair of friction paddles secures the body portion via weight of a mattress.

19. The apparatus of claim 13 further comprising strap attachment means on each side of the body portion, wherein each of the pair of straps are removably attachable to each side of the body portion.

20. The apparatus of claim 13, wherein the at least one organizer cavity has a unique shape that facilitates storage of a specific item.

* * * * *